United States Patent [19]

Homestead

[11] 4,278,287

[45] Jul. 14, 1981

[54] FOLDING SEATING PIECE

[75] Inventor: Peter W. Homestead, San Clemente, Calif.

[73] Assignee: Scott Paper Company, Philadelphia, Pa.

[21] Appl. No.: 72,325

[22] Filed: Sep. 4, 1979

[51] Int. Cl.[3] ..... A47C 4/00

[52] U.S. Cl. ..... 297/59; 297/41; 297/60

[58] Field of Search ..... 297/59, 60, 41, 46, 297/55, 16; D6/76, 41; 108/119

[56] References Cited

U.S. PATENT DOCUMENTS

| | | | |
|---|---|---|---|
| 119,754 | 10/1871 | Gardner | 297/59 |
| 227,619 | 5/1880 | Dexter et al. | 297/59 X |
| 2,382,300 | 8/1945 | Dick | 297/59 |
| 2,467,963 | 4/1949 | Carlson | 297/59 |
| 3,207,093 | 9/1965 | Block | 108/119 |

*Primary Examiner*—James T. McCall

*Attorney, Agent, or Firm*—Martin L. Faigus; William J. Foley

[57] ABSTRACT

A folding seating piece, preferably in the form of a chair (10) includes pivotally interconnected frames (12, 14 and 16) forming a seat, backrest and armrests. A frame member (28) of the seat adjacent each side of the chair includes a snap fastener (40) connected thereto; each of said fasteners including a laterally extending guide section (46) and a downwardly directed clip section (48). The guide section of each clip overlies an adjacent frame member (34) for engaging, and being adapted to move along the adjacent frame member as the chair is being pivoted into its open position. The clip section of each snap fastener generally aligns with an additional frame member (38) of the chair when its respective guide section is closely positioned to the adjacent frame member it overlies and the chair is in its desired opened position.

3 Claims, 5 Drawing Figures

FOLDING SEATING PIECE

TECHNICAL FIELD

This invention relates generally to a folding seating piece, and more particularly to a folding seating piece of the type provided with a seat, backrest and armrests.

BACKGROUND ART

There are a wide variety of folding chair constructions and other folding seating pieces that are employed for indoor and outdoor use. It is a well-known fact that many of these folding constructions are flimsy and rickety. Moreover, many of these constructions employ unsightly mechanisms to permit the folding operation to be achieved. In designing high quality folding chairs that are readily adaptable for either indoor or outdoor use it is highly desirable to approximate, as close as possible, the appearance and performance (e.g., strength, durability, etc.) attributes typically associated with non-folding chair constructions. It is to such a folding seating piece that the present invention is directed.

DISCLOSURE OF INVENTION

A folding seating piece, preferably in the form of a chair, includes pivotally interconnected frames forming a seat, backrest and armrests. A frame member of the seat adjacent each side of the seating piece includes a snap fastener thereon, and each of the fasteners includes a laterally extending guide section overlying an adjacent frame member of the seating piece for engaging, and being adapted to move along said adjacent frame member as the seating piece is being pivoted into its open position. Each of the snap fasteners also includes a clip section that generally aligns with an additional frame member of the seating piece when the guide section of the fastener is closely positioned to the frame member it overlies, and the chair is in its desired open position, whereby downward force on the seat will cause the clip section of each fastener to positively connect to its generally aligned frame member to form an extremely stable construction.

In a preferred embodiment of the invention a rear frame forms the backrest of the seating piece, a front frame, pivotally connected to the rear frame, includes frame members providing the armrests of the seating piece and a seat frame is pivotally connected adjacent the back thereof to the rear frame. The snap fasteners are secured adjacent sides of the seat frame at the front thereof. When the seating piece is opened for use the pivot connections and the snap fastener connections are arranged at the corners of a triangle on each side of seating piece to form the stable construction.

The unique snap fasteners employed in this invention preferably are molded as single units out of a suitable plastic material, such as Nylon 801, and these fasteners eliminate the need for utilizing unsightly linkage systems that clearly "advertise" the fact that the seating piece is of the folding type. Moreover, the combined effect of the laterally extending guide section and clip section associated with each of the snap fasteners provides for the automatic alignment of each clip section with its generally aligned frame member when the chair is in its desired open position to permit the easy connection of each clip section to its aligned frame member.

In the preferred embodiment of this invention the clip section of each fastener includes an opening having a downwardly directed entrance orifice. This orifice is narrower than the maximum transverse dimension of the frame member to which it is intended to be connected. As a result of this arrangement the clip section will be forced to expand as it moves about the frame member, and thereafter contract on the frame member to form a firm, stable connection. Most preferably each clip section includes inclined surfaces that are directed downwardly and outwardly away from the entrance orifice at the opposite sides thereof for engaging and guiding the generally aligned frame member into said orifice when necessary.

Other objects and advantages of this invention will become apparent by referring to the description of the best mode of the invention, taken in conjunction with the drawings.

BEST MODE FOR CARRYING OUT THE INVENTION

Figure 1:
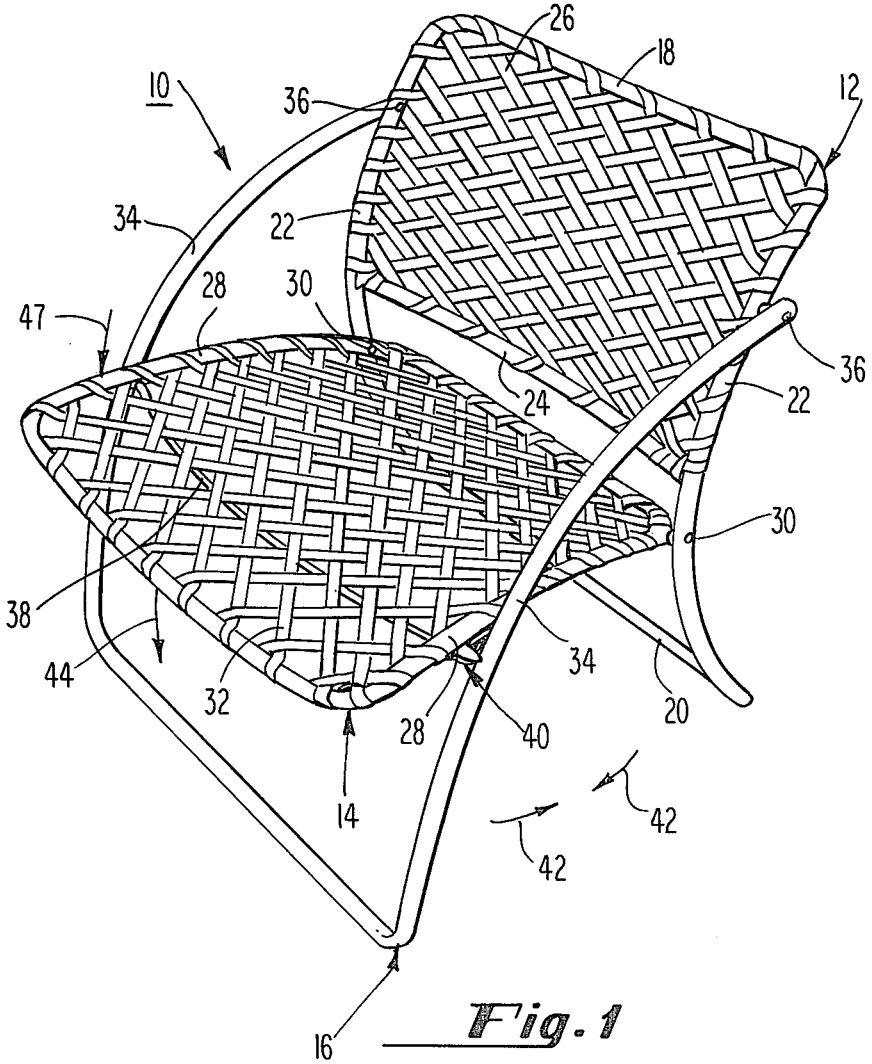
FIG. 1 is a perspective view of a folding seating piece, in the form of a chair, in accordance with this invention.

Referring to FIG. 1, a folding chair 10 in accordance with this invention is depicted. The basic framework of the chair includes a rectangular rear frame 12, a rectangular seat frame 14 and a generally U-shaped front frame 16.

Figure 2:
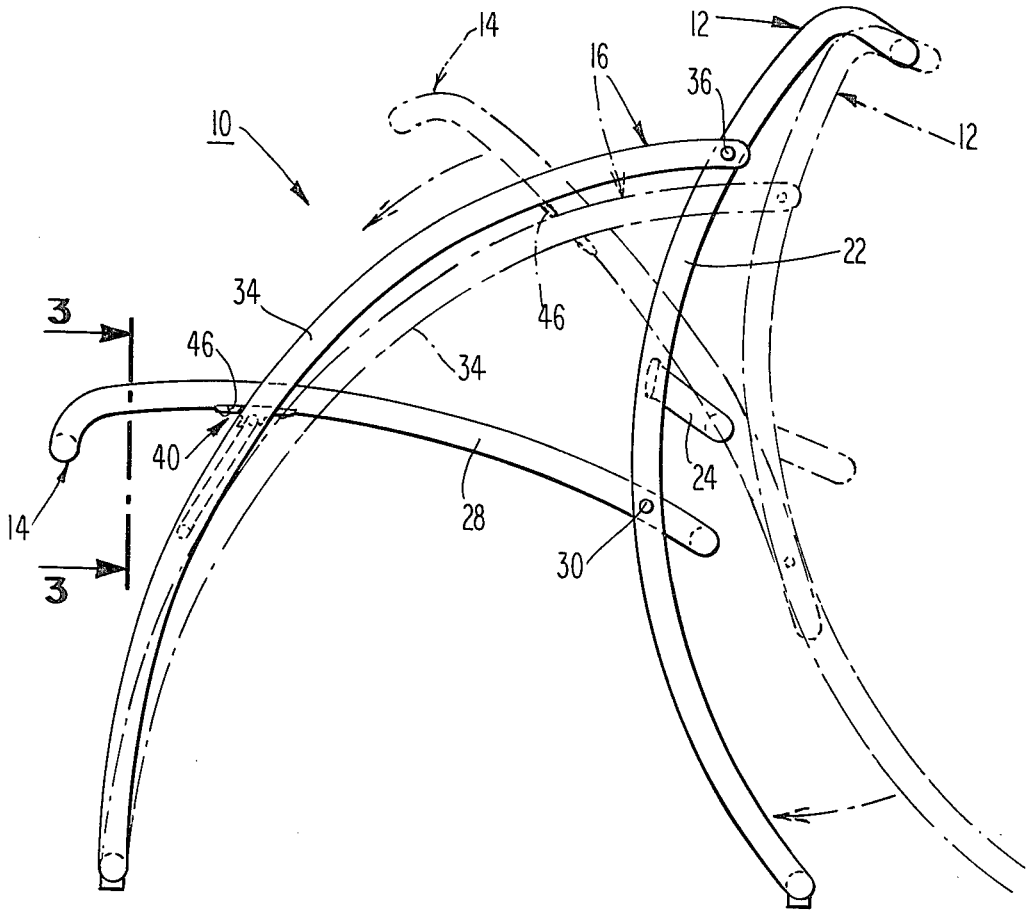
FIG. 2 is a side elevation view of the chair shown in FIG. 1 with an intermediate position achieved in the opening operation being shown in phantom.

Referring to FIGS. 1 and 2, the rectangular rear frame 12 includes upper and lower horizontal frame members 18 and 20, respectively, interconnected by laterally spaced-apart, generally vertical, curved side frame members 22. An intermediate horizontal frame member 24 is connected to the laterally spaced-apart side frame members 22, and cooperates with these side frame members and the upper horizontal frame member 18 to receive a suitable covering, such as lacing 26, to form the backrest of the chair. The lower section of the rectangular rear frame 12 forms the rear legs of the chair.

The rectangular seat frame 14 includes laterally spaced-apart side frame members 28 pivotally connected adjacent the rear thereof to the curved side frame members 22 of the rear frame 12. This pivotal connection is achieved through horizontally aligned rivets 30 below the intermediate horizontal frame member 24 of the rear frame 12. A suitable covering, such as lacing 32, is connected with the frame members of the seat frame 14 to complete the formation of the seat.

Still referring to FIGS. 1 and 2, the generally U-shaped front frame 16 includes generally curved side members, or arms 34 pivotally connected adjacent their free ends to the curved side frame members 22 of the rear frame 12. This connection is made through horizontally aligned rivets 36 at each side of the chair. Note that the curved side members 34, adjacent the upper end thereof, form the armrests of the chair 10, and the lower section of the frame 16 forms the front legs of the chair.

Figure 5:
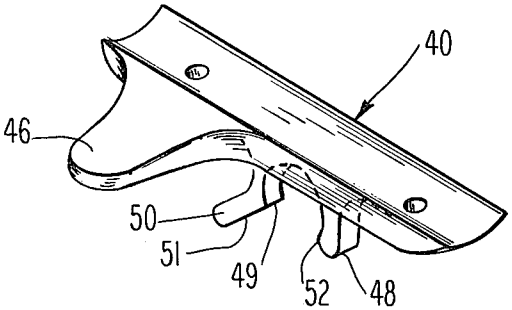
FIG. 5 is a perspective view of a unique snap fastener employed in the folding seating pieces of this invention.

The front frame 16 further includes an intermediate brace 38 extending laterally between, and being welded to the side members 34 of the front frame 16. This laterally extending brace is intended to be connected adjacent each of its ends with a unique snap fastener 40 (FIG. 5). The specific details regarding the manner in which the snap fasteners 40 function in this invention will be described later. However, it should be understood that the major purpose of the brace 38 is to provide a member associated with the front frame 16 that can be engaged by the snap fasteners 40 when the chair is opened. This function could be achieved by replacing the single, laterally extending brace 38 with separate members extending inwardly from each side member 34.

Referring again to FIG. 1, when the folding chair 10 is collapsed, which generally is the case when it is being shipped or stored, the snap fasteners 40 are disengaged from the brace 38. The rectangular rear frame 12 and generally U-shaped front frame 16 are then pivoted into close proximity to each other, in the direction of arrows 42, about the connection provided by rivets 36. The seat frame 14 is thereafter pivoted downwardly, in the direction of arrow 44, about its connection to the rear frame 12 provided by the rivets 30. The manner in which the chair is handled to most easily open it will be described later.

Figure 4:
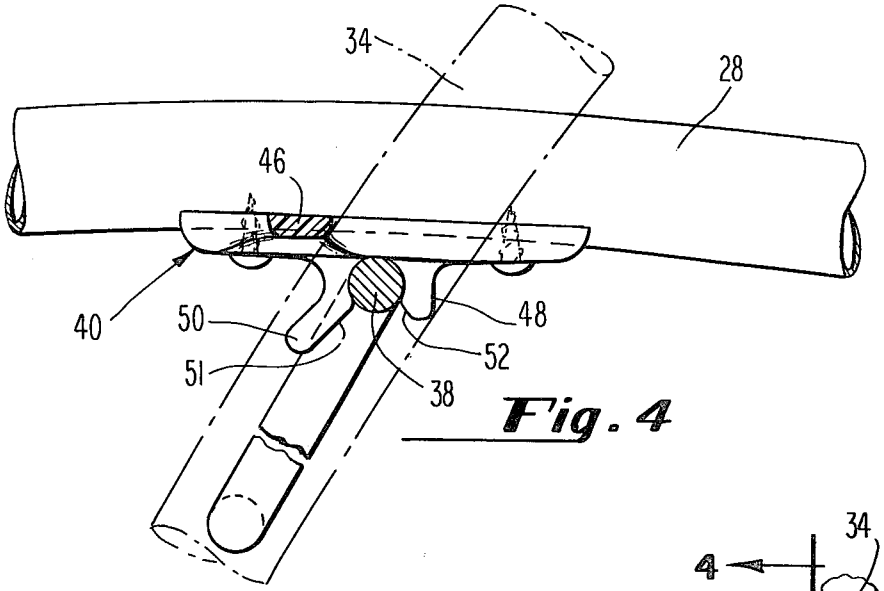
FIG. 4 is a sectional view along 4—4 of FIG. 3.
Figure 3:
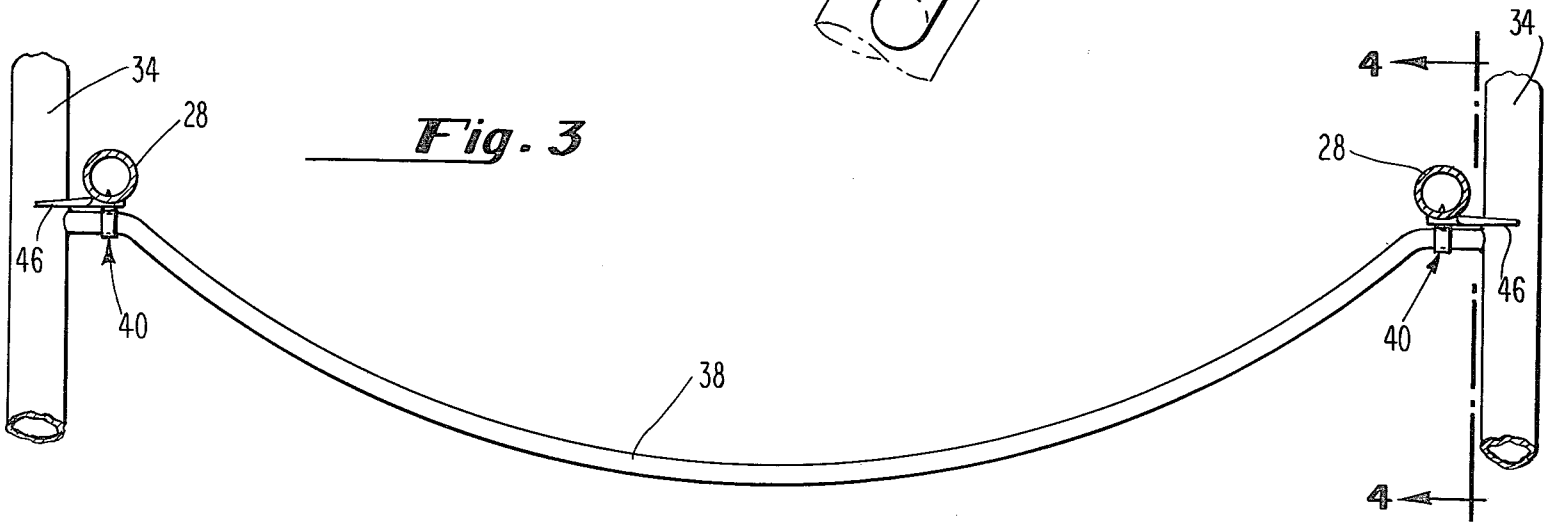
FIG. 3 is a transverse sectional view along 3—3 of FIG. 2.

Referring specifically to FIGS. 3–5, unique snap fasteners 40 eliminate the need for utilizing complex and unsightly connecting linkage systems between frame members of the chair, and these snap fasteners 40 are self-locating and easily lockable with generally aligned frame members of the chair when the chair is in its desired open position. As can be seen best in FIG. 3, the chair is provided with two snap fasteners 40; one being located adjacent each lateral side of the chair 10. These snap fasteners are mirror images of each other; and therefore, only one of them (the one located at the right, as viewed in FIG. 3) will be described in detail.

As can be seen best in FIG. 5 each snap fastener 40 preferably is molded as a single unit, and includes a laterally extending guide arm 46 adjacent a forward end thereof and a clip section 48 spaced slightly rearward of said arm. The guide arm 46 of each fastener is adapted to overlie the generally curved side frame member 34 to which it is adjacent, as can be seen best in FIG. 3. Since the guide arms are adapted to overlie the side frame members 34 they are capable of engaging these frame members as the front and rear frames 16 and 12, respectively, are being pivoted apart to open up the chair. Since the brace 38 forms a part of the front frame 16 it will be aligned in a predetermined relationship with the snap fasteners 40 when the guide arms 46 are in engagement with, or in close proximity to, the side frame members 34 they overlie.

The clip section 48 of each fastener is provided with an opening having a downwardly facing entrance orifice 49 into it. The orifice 49 has a smaller, or narrower dimension than the cross-sectional dimension of the brace 38 to which it is to be connected. Thus the arms of the clip section 48 are required to expand slightly as the clip section is being snapped over the brace 38, and thereafter contrast to firmly connect the brace and clip section together.

Referring to FIG. 4, the clip section 48 is positioned relative to the laterally extending guide arm 46 so that it will be generally aligned with the laterally extending brace 38 when the guide arm 46 engages, or is in close proximity with the side members 34 of the front frame 16, and the chair is in its desired open position. Thereafter, merely applying a downward force to the seat frame 14, in the direction of arrow 47 (FIG. 1), will cause the clip section 48 to snap into positive locking engagement with the laterally extending brace 38.

Referring to FIGS. 4 and 5, each snap fastener 40 is provided with an extension 50 at the front of the clip section 48 that provides an inclined surface 51 directed downwardly and outwardly of the entrance orifice 49. Likewise, the rear of clip section includes a downwardly and outwardly inclined surface 52. Both of the inclined surfaces are oriented substantially 45 degrees from the vertical and provide an additional self-locating feature for directing the brace 38 into the entrance orifice 49 of the generally aligned clip sections 48 as the seat frame 14 is pressed downwardly in the direction indicated by arrow 49 (FIG. 1). Obviously movement of the brace 38 along either the inclined surface 51 or along the inclined surface 52 will be accompanied by pivotal movement of the rear and front frames 12 and 16, respectively, relative to each other.

Referring to FIG. 2 a preferred manner of opening the chair 10 will be described. The seat frame 14 initially can be pivoted upwardly about its connection to the rear frame 12, preferably to a position above that which is desired when the chair is opened for use (i.e., to a position forming an acute angle with the upper backrest section of the rear frame 12, as is shown in phantom representation). The front frame 16 is then pivoted outwardly away from the rear frame 12 about its pivot connection to the rear frame until the curved side frame members 34 engage the guide arms 46 of each of the snap fasteners 40. Note that the snap fasteners 40 are joined to the laterally spaced-apart side frame members of the seat frame 14 through suitable securing means, such as screws. After the side frame members 34 engage the guide arms 46, the seat frame 14 can be pivoted downwardly towards its horizontal seating orientation to cause movement of the front frame 16 toward the rear frame 12. This movement is caused by the engagement of the laterally extending guide arms 46 with the curved side frame members 34 of the frame 16 as the seat is being moved into its final seating position. The orientation and arrangement of the various frame members when the chair is opened for use is shown in solid representation in FIG. 2.

When the seat frame 14 is in its desired horizontal seating position the clip section 48 of each fastener 40 is automatically generally aligned with the horizontally extending brace 38 of the front frame 16. If there is not precise alignment of the entrance orifice 49 of the clip section with the brace 38, the brace will engage either the inclined surface 51 or 52, depending upon which direction the alignment is off. Thereafter, downward movement of the seat frame 14 will cause the brace 38 to move along the engaged inclined surface into the entrance orifice 49 of the clip section 48. Thus, a downward force applied to the seat frame will cause the clip sections 48 of each of the snap fasteners 40 to snap into firm retaining engagement with the brace 38 to positively connect the seat frame 14 to the front frame 16 adjacent each side of the chair. This snap connection, in combination with the pivotal connections provided by the rivets 30 and 36, provide a triangular connecting configuration at each side of the chair to establish an extremely stable construction when the chair 10 is opened for use.

Having described my invention, I claim:

1. A folding seating piece including pivotally interconnected frames forming a seat, backrest and armrests; characterized in that a frame member of the seat adjacent to each side of the seating piece includes a unitary snap fastener thereon, each of said fasteners including a laterally extending guide section overlying an adjacent frame member of the seating piece for engaging, and being adapted to move along said adjacent frame member as the seating piece is being pivoted into its open position, each of said snap fasteners including a clip section that generally aligns with an additional frame member of the seating piece when its respective guide section is closely positioned to the adjacent frame member it overlies and the chair is in its desired open position, said clip section including a downwardly facing entrance orifice that is narrower than the additional frame member and an extension providing an inclined surface directly downwardly and outwardly from said entrance orifice, whereby a downard force applied to the seat directs the additional frame member along the inclined surface of the extension into the entrance orifice to cause said clip section to expand and snap around the additional frame member to which it connects.

2. The folding seating piece of claim 1 including a rear frame forming the backrest of the seating piece, a front frame pivotally connected to the rear frame and including frame members providing the armrests of the seating piece and a seat frame pivotally connected to the rear frame and including frame members adjacent each armrest-forming frame member of the front frame, characterized in that a snap fastener is connected to a seat frame member adjacent each armrest-forming frame member, the laterally extending guide section of each snap fastener being located to overlie its adjacent armrest-forming frame member for engaging, and being adapted to move along said adjacent armrest-forming frame member as the chair is being pivoted into its open position, the clip section of each snap fastener being generally aligned with a horizontally extending frame member of the front frame when the guide sections of the fasteners are closely positioned to the armrest-forming frame members and the chair is in its desired opened position.

3. The folding seating piece of claim 1 wherein each snap fastener includes inclined surfaces extending outwardly from opposite sides of the entrance orifice of the clip section for guiding the generally aligned adjacent frame member into said orifice.

* * * * *